US005409401A

United States Patent [19]

Schaarschmidt et al.

[11] Patent Number: 5,409,401

[45] Date of Patent: Apr. 25, 1995

[54] FILTERED CONNECTOR

[75] Inventors: Manfred Schaarschmidt, Bensheim-Schönberg; Günter Feldmeier, Lorsch, both of Germany; John C. Farrar; James F. Iannella, both of Harrisburg, Pa.

[73] Assignee: The Whitaker Corporation, Wilmington, Del.

[21] Appl. No.: 129,216

[22] Filed: Sep. 29, 1993

Related U.S. Application Data

[63] Continuation-in-part of Ser. No. 971,164, Nov. 3, 1992, Pat. No. 5,269,705.

[51] Int. Cl.[6] ..... H01R 13/66

[52] U.S. Cl. ..... 439/620

[58] Field of Search ..... 435/620, 676

[56] References Cited

U.S. PATENT DOCUMENTS

| | | | |
|---|---|---|---|
| 4,331,948 | 5/1982 | Malinaric et al. | 338/21 |
| 4,371,226 | 2/1983 | Brancaleone | 339/147 R |
| 4,473,755 | 9/1984 | Imai et al. | 307/10 R |
| 4,552,423 | 11/1985 | Swengel, Jr. | 339/19 |
| 4,660,907 | 4/1987 | Belter | 339/14 R |
| 4,679,879 | 7/1987 | Triner et al. | 439/425 |
| 4,695,115 | 9/1987 | Talend | 439/76 |
| 4,714,435 | 12/1987 | Stipanuk et al. | 439/496 |
| 4,726,638 | 2/1988 | Farrar et al. | 439/620 R |
| 4,726,991 | 2/1988 | Hyatt et al. | 428/329 |
| 4,729,752 | 3/1988 | Dawson, Jr. et al. | 439/620 |
| 4,772,224 | 9/1988 | Talend | 439/607 |
| 4,791,391 | 12/1988 | Linnell et al. | 333/184 |
| 4,799,901 | 1/1989 | Pirc | 439/620 |
| 4,804,332 | 2/1989 | Pirc | 439/620 |
| 4,822,304 | 4/1989 | Herron | 439/610 |
| 4,838,811 | 6/1989 | Nakamura et al. | 439/607 |
| 4,878,858 | 11/1989 | Dechelette | 439/607 |
| 4,931,754 | 6/1990 | Moussie | 333/184 |
| 4,950,185 | 8/1990 | Boutros | 439/620 |
| 4,977,357 | 12/1990 | Shrier | 338/21 |
| 4,983,935 | 1/1991 | Mouissie | 333/184 |
| 5,018,989 | 5/1991 | Black et al. | 439/620 |
| 5,068,634 | 11/1991 | Shrier | 338/21 |
| 5,069,641 | 12/1991 | Sakamoto et al. | 439/620 |
| 5,080,595 | 1/1992 | Mouissie | 439/67 |
| 5,082,457 | 1/1992 | Wollscheidt et al. | 439/620 |
| 5,099,380 | 3/1992 | Childers et al. | 361/56 |
| 5,140,299 | 8/1992 | Andrews, Jr. et al. | 338/308 |
| 5,142,263 | 8/1992 | Childers et al. | 338/21 |
| 5,147,223 | 9/1992 | Black et al. | 439/620 |
| 5,150,086 | 9/1992 | Ito | 333/182 |
| 5,151,054 | 9/1992 | Briones et al. | 439/620 |
| 5,224,878 | 7/1993 | Lurie et al. | 439/620 |
| 5,246,388 | 9/1993 | Collins et al. | 439/620 |
| 5,269,705 | 12/1993 | Iannella et al. | 439/620 |
| 5,269,708 | 12/1993 | De Young et al. | 439/676 |

OTHER PUBLICATIONS

Ser. No. 949,655 filed Sep. 23, 1992 for Bunch et al.

Ser. No. 971,028 filed Nov. 3, 1992 to Ianella et al.

*Electromer Drawing No. FLx-XXB001,* "Multi-Line ESD Protection Array for D-submin Connectors", Revision E, Sep. 23, 1991; Electromer Corporation, Belmont, Calif.

*Electromer Drawing No. PCE-SMO1CO1O,* "Specification Control Drawing", Revision TM, Apr. 11, 1991; Elctromer Corporation, Belmont, Calif.

*Primary Examiner*—Eugene F. Desmond

*Attorney, Agent, or Firm*—Mary K. Van Atten; Timothy J. Aberle

[57] ABSTRACT

An electrical connector (2) comprising rows of terminals (6) therein has capacitance filter elements (36,38) bonded to side walls (14,16) thereof. The filter elements are comprised of a thin dielectric film laminated on either side with conductive material, the one side serving as a ground electrode and the other side divided into a plurality of signal electrodes separated by gaps formed by conventional etching process. The filter elements also have connection tabs (48,49) extending from a lower end (50) thereof, each tab connected to a separate electrode (42,44) and electrically connected to corresponding terminals (6) of the connector (2). The invention therefore provides for a readily manufacturable and cost effective filtered connector for filtering unwanted frequency components of a signal to be carried, the filter being mountable to the connector housing in an unobtrusive and compact manner.

20 Claims, 3 Drawing Sheets

FILTERED CONNECTOR

This application is a continuation-in-part of application Ser. No. 07/971,164, filed Nov. 3, 1992, now U.S. Pat. No. 5,269,705.

BACKGROUND OF THE INVENTION

1. Field of the Invention

This invention relates to an electrical connector for carrying signals, the connector having a filter element secured thereto for filtering unwanted frequency components of the signals.

2. Description of the Prior Art

The increasing use of high speed digital pulses for communication has lead to the use of sensitive components to receive and manipulate such signals. This sensitivity has in turn made the components vulnerable to unwanted frequencies transmitted thereto on the same signal path as the wanted signal frequencies. To solve the problem caused thereby, a number of developments have lead to patents that purport to filter out unwanted frequencies using electrical connectors as the vehicle for accommodating appropriate filters. U.S. Pat. No. 4,695,115 granted Sep. 22, 1987, relates to a telephone connector with by-pass capacitor and teaches the use of capacitors built into the connector to filter out unwanted frequencies from the signals carried thereby. Means are provided for interconnecting such capacitors between the signal paths and grounding paths. As will be discerned, the filters occupy a considerable proportion of the total volume of the connector.

U.S. Pat. No. 4,772,224 granted Sep. 20, 1988 represents a modular electrical connector which includes capacitors and additionally, ferrite inductors to provide filtering. As with U.S. Pat. No. 4,695,115, the filter elements take up considerable volume, raising the height of the device above a printed circuit board or part of the assembly served by the filtered connector.

It is therefore an object of the present invention to provide a connector having filter means that add minimally to the dimensions of the connector.

It is a further object of this invention to provide a connector with filter means that are disposed on the exterior surface of the connector housing in an unobtrusive way.

It is yet another object of this invention to provide a simple and readily manufacturable filter construction that is cost effective yet reliable.

It is yet another object of this invention to provide an electrical connector having compact filter means and a plurality of identical terminals, whereby grounding of the filters is accomplished through one or more of these terminals, the other terminals used for carrying signals.

SUMMARY OF THE INVENTION

The objects of this invention are achieved by providing an electrical connector for carrying signals that could have unwanted frequency components, the connector having a number of electrical terminals greater than or equal to N, where N is an integer greater than 0, and filter means for filtering the unwanted frequency components, characterized in that the filter means comprises at least one filter element comprising a dielectric layer having a thin conductive layer of ground electrode on one side and a thin conductive layer divided into no more than N−1 distinct signal electrodes on the other side, whereby the filter element is electrically connected to N terminals of the connector; each signal electrode being connected to a separate said terminal and the layer of ground electrode being connected to the remaining one or more said terminals.

In this way, the filter element is therefore a thin flat part that can comprise a plurality of filters deposited on the dielectric layer and connectable, grounding electrode included, to terminals of the connector. The signal electrodes on the one side of the dielectric layer, and the ground electrode on the other side, can be manufactured by laminating a metal foil on each side and etching gaps to form the electrode contours, the dielectric layer then being cut to provide the filter elements. The latter process is therefore a simple and cost effective manufacturing process. The filter element can be mounted flush on a side wall of the connector and make contact with terminals of the connector by extending tabs from the electrodes contiguous corresponding tab terminals of the connector that extend beyond a mounting face thereof. The connected filter and terminal tabs can then be inserted through holes of a printed circuit board for electrical connection to circuit traces thereof. A connector embodiment comprising two rows of parallel terminals, can have two filter elements, one on either side of the connector, whereby the filter elements could be made in an identical manner which reduces manufacturing costs.

DETAILED DESCRIPTION OF THE PREFERRED EMBODIMENT

Figure 2:
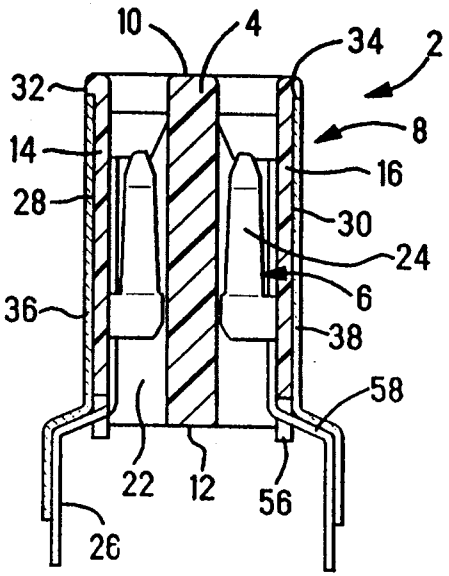
FIG. 2 is a cross sectional view through the connector of FIG. 1.
Figure 1:
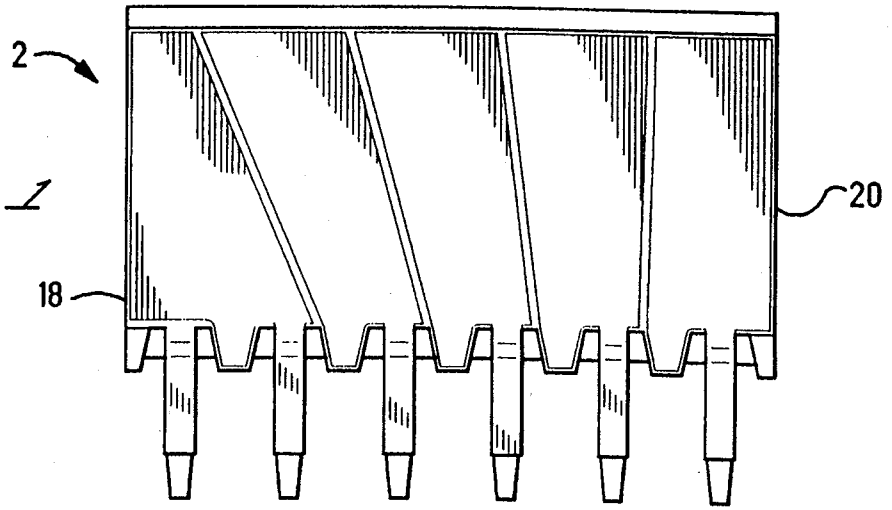
FIG. 1 is a side view of an embodiment of this invention.
Figure 3:
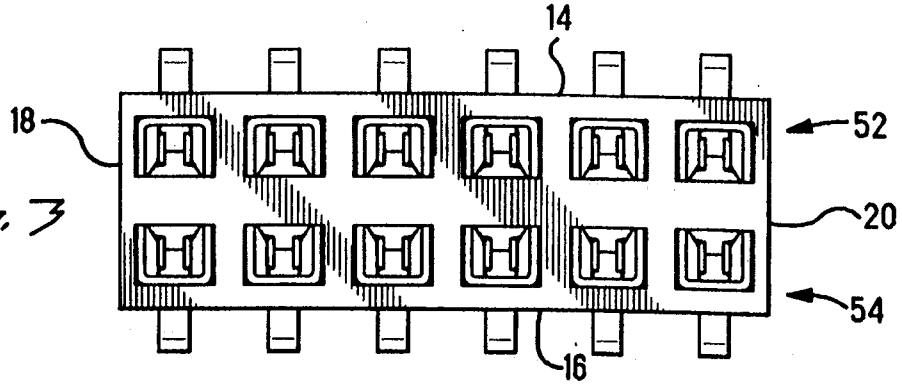
FIG. 3 is a top view of the connector of FIG. 1.

Referring to FIGS. 1, 2, and 3, an electrical connector generally shown at 2 comprises a connector housing 4, a plurality of terminals 6 and filter means 8. The connector housing 4 comprises a complementary connector mating face 10 and an opposing printed circuit board mounting face 12, side walls 14 and 16 extending therebetween and end walls 18 and 20 extending between lateral ends of the side walls 14,16. The connector housing 4, also comprises terminal receiving cavities 22 extending therethrough from the mounting face 12 to the mating face 10. The terminals 6, comprise a complementary contact mating section 24 and extending therefrom beyond the mounting face 12, is a conductor contact section 26 shaped as a flat pin for reception in a hole of a printed circuit board (PCB). The connector side walls 14,16, comprise a filter element receiving surface, 28,30 respectively, which are recessed with respect to a upper wall surfaces 32,34 proximate the mating face 10.

The filter means 8 comprises filter elements 36,38, each filter element composed of a dielectric layer 40 made from a polymer/ceramic composite for example, the layer laminated with a conductive material such as metal foil.

Figure 4:
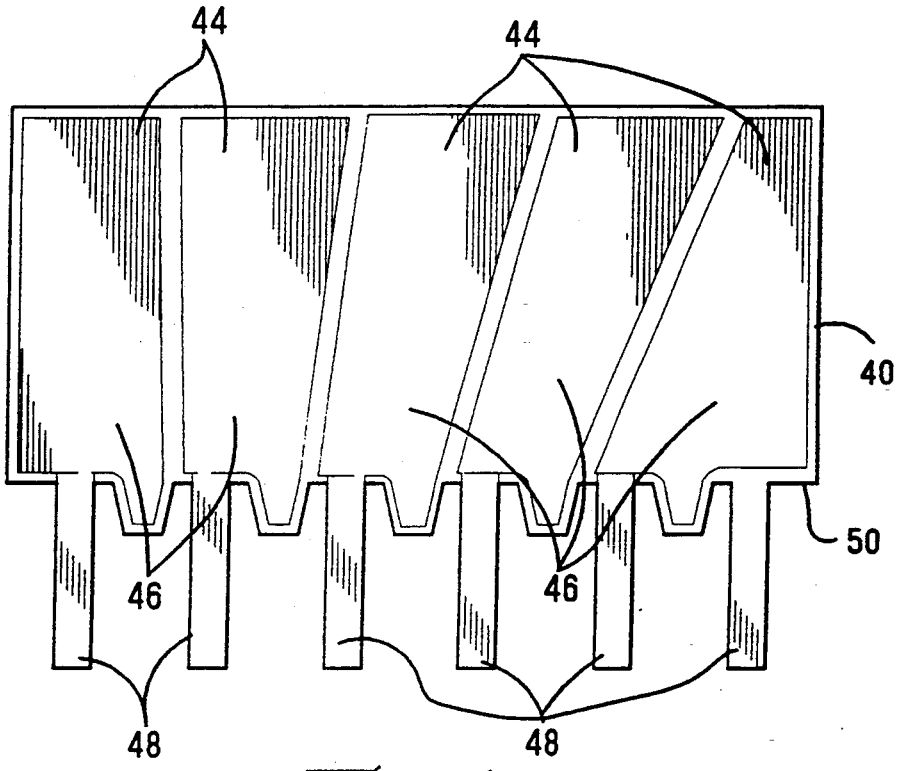
FIG. 4 is a view of the signal electrode side of a filter element.
Figure 5:
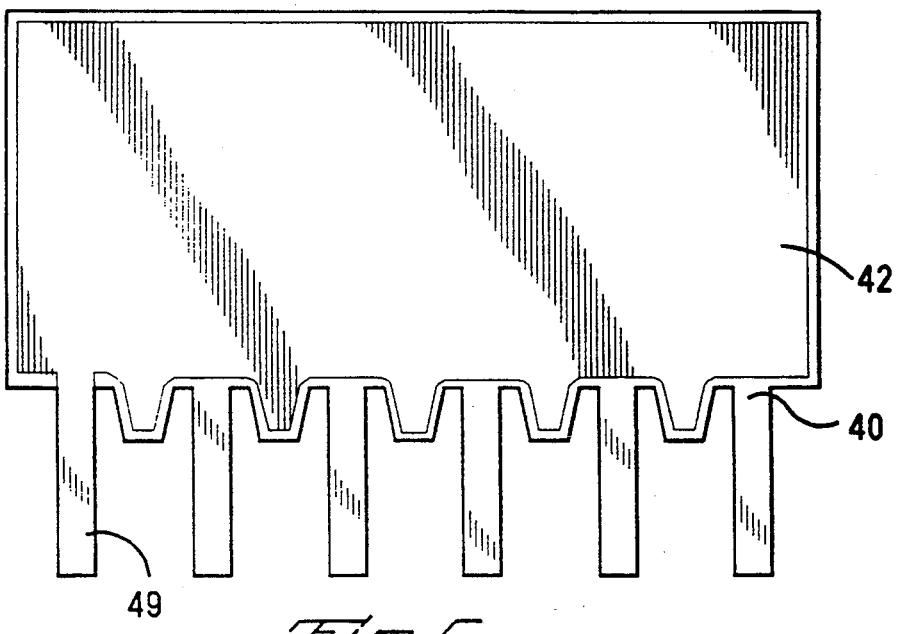
FIG. 5 is a view of the other side of the filter element shown in FIG. 4 showing the ground electrode.

Referring now to FIGS. 4–5, the thin conductive layer, forms on one side of the dielectric 40, a ground electrode 42 substantially covering the whole surface thereof, and on the other side, a plurality of signal electrodes 44 separated by dielectric gaps 46 that can be made by etching the conductive layer by common industrial methods. The gaps 46 therefore electrically disconnect the various signal electrodes 44, each signal electrode 44 thus being distinct. The dielectric layer 40 comprises N connection tabs 48,49 extending in a juxtaposed and parallel manner from a bottom edge 50 thereof. Each of the connection tabs 48,49 is electrically connected to an electrode 42,44 whereby there is one ground electrode 42 and N−1 signal electrodes 44. Electrical connection between the connection tabs 48 and the signal electrodes is simply made by having a thin conductive layer of electrode thereon integral with the corresponding electrodes 44, and similarly the ground connection tab 49 has a conductive layer integral with the ground electrode 42.

The surface area and rectangular shape of the filter elements 36,38 is substantially the same as that of the connector side wall surfaces 28,30 whereby the depth of the recess thereof is substantially the same as the thickness of the filter elements such that they can be mounted flush to the upper protruding surfaces 32,34 of the connector (see FIG. 2). The latter disposition results in a compact configuration without obtrusive portions that are at more risk to damage. Each filter element 36,38 is adapted for electrical connection with two rows 52,54 of terminals 6, each row 52,54 adjacent a side wall 14,16 respectively. Electrical contact of the filter element 36 or 38 to the row of terminals 52 or 54 respectively, is made between the connection tabs 48,49 and the terminal pin sections 26. The terminal pin sections 26 are arranged in a spaced juxtaposed disposition contiguous with the corresponding connection tabs 48,49, and are electrically connected theretogether by solder material deposited around the pin sections 26 and tabs 48,49, whereby the solder material is also connected to corresponding circuit traces of a printed circuit board on which the connector 2 is mounted. N−1 signal terminals (in this case N=6) are connected to signal electrodes 48 of one of the filter elements 36 and the remaining terminal of the row 52 is reserved for connection to the ground electrode 42 via the connection tab 49. In a similar manner, the filter element 38 is connected to the row of terminals 54. The filter elements 36,38 can be attached to the connector side walls 14,16 by bonding with an adhesive common in the industry. The connector 2 can then be mounted to a printed circuit board having rows of holes therein for reception of the terminal pin sections 26 (and attached filter connection sections 48,49), whereby stand-off projections 56 extending from the side walls 14,16 between the terminals 6, project below the mounting face 12 and serve to correctly space the connector mounting face from the printed circuit board (not shown). The latter allows a certain clearance for bending a mid section 58 of the terminal pin sections 26, the bent sections 58 providing a position to which the filter element connection tabs 48,49 can converge and be bonded to. Once the connector 2 has been mounted on a printed circuit board, the contiguous terminal pins 26 and filter connection tabs 48,49 are soldered to electrical trace material lining the printed circuit board holes thus electrically connecting the corresponding connection tabs and the terminals thereto.

The filter elements 36,38 are in fact flexible capacitance filters and can be formed by first laminating respective layers of conductive material to respective surfaces of a sheet of dielectric material, after which an etching process defines the boundaries of the respective electrodes, in which process a plurality of such filters can conveniently be fabricated. Preferably outwardly facing surfaces of the electrodes have an insulative covering after etching, such as by spraying with a polymer paint or by lamination to a polymeric film, except at the connection tabs 48,49 of the electrodes. The signal electrodes 44, one for each of the signal terminals 6, have areas selected in conjunction with the particular dielectric material having a particular dielectric constant and the thickness of the conductive layer to provide a desired capacitance associated with each signal contact and in essence connecting each signal contact through the capacity of the material to ground through the common ground electrode 42.

As is well known, capacitance is a function of area of electrode, dielectric constant of the dielectric material, and the spacing between electrodes with capacitance values decreasing as the space between electrodes is increased and with capacitance increasing with the dielectric value increasing. The dielectric material, in one embodiment of the invention, is made of a film of polymeric material such as RHEOPLEX LC 40 Acrylic emulsion adhesive sold by Rohm and Haas, Inc., Philadelphia, Pa., having a matrix of acrylic polymer with barium titanate filler homogeneously dispersed therein in the order of about 50% by weight, with a particle size of about one micron. The conductive layers, in the preferred embodiment, are of copper joined to the sheet of dielectric material with a three ply heat and pressure laminating machine. One embodiment where the electrodes were 0.0014" thick and the substrate 0.002" thick, and the individual electrodes on the order of 0.2" wide and 1" in length, the capacitance varied between 400 and 480 picofarads. The resulting capacitance provided an attenuation beginning at the order of several decibels insertion loss at slightly less than 10 MHz rising to the order of 12 to 15 dB at around 100 MHz and peaking for the 400 picofarad capacitance at about 34 dB at around 250 MHz. The 480 picofarad sample had an insertion loss at slightly less than 30 dB at a frequency of around 200 to 300 MHz. Use of an appropriate amount of barium titanate in the polymer further provides a voltage withstanding of 1000 volts or greater, needed for certain FCC requirements.

Alternatively a pair of opposing foils of anodized aluminum could be utilized, laminating to a sheet of barium titanate-filled polymer; or a coating of barium titanate-filled polymer may be screen printed or sprayed onto one sheet of foil as the other foil sheet is then laminated thereonto; and then after application of masking of the appropriate geometry, the foil sheets are etched in a conventional manner to result in a structure similar to the etched electrode structure described above, after which dielectric coating such as 350 CC epoxy sold by Mavidon Corp., Palm City, Fla., may be applied to one or both electrode outer surfaces. The tape filters may then be cut from the sheet of dielectric material.

If the terminals 6 of one or the other row 52,54 require capacitance values that are equivalent, then the filter element is divided into N−1 signal electrodes 44 of equal surface area, the signal electrode surface area of the filter element thus being apportioned into N−1 signal electrode surface areas.

Figure 7:
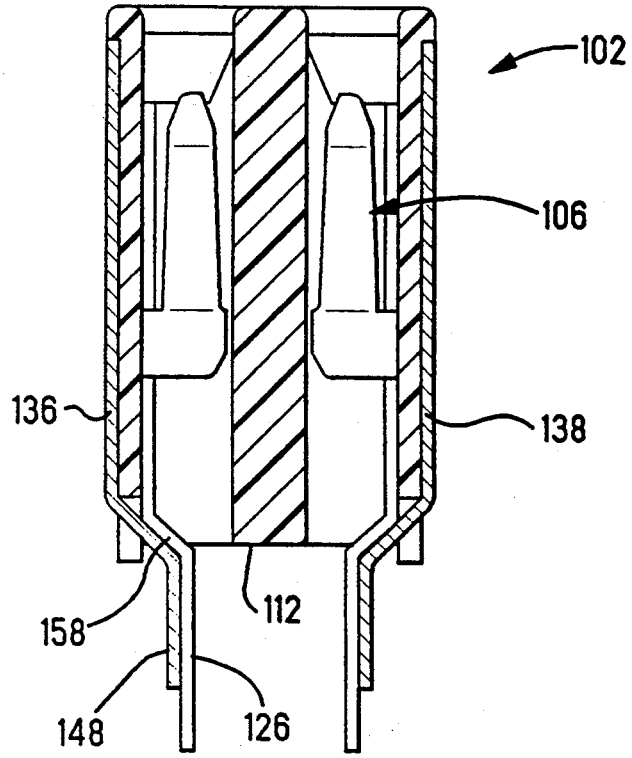
FIG. 7 is a cross sectional view through yet another embodiment of this invention.

Referring to FIG. 7, another embodiment 102 of this invention is shown whereby terminals 106 have PCB connecting sections 126 bent towards each other via a middle section 158. Filter element 136,138 connection tabs 148 are accordingly bent inwards for bonding against the corresponding terminal PCB connection sections 126. The embodiments shown in FIG. 2 and FIG. 7 are merely design choices based on the desired hole spacing on the printed circuit board.

Figure 6:
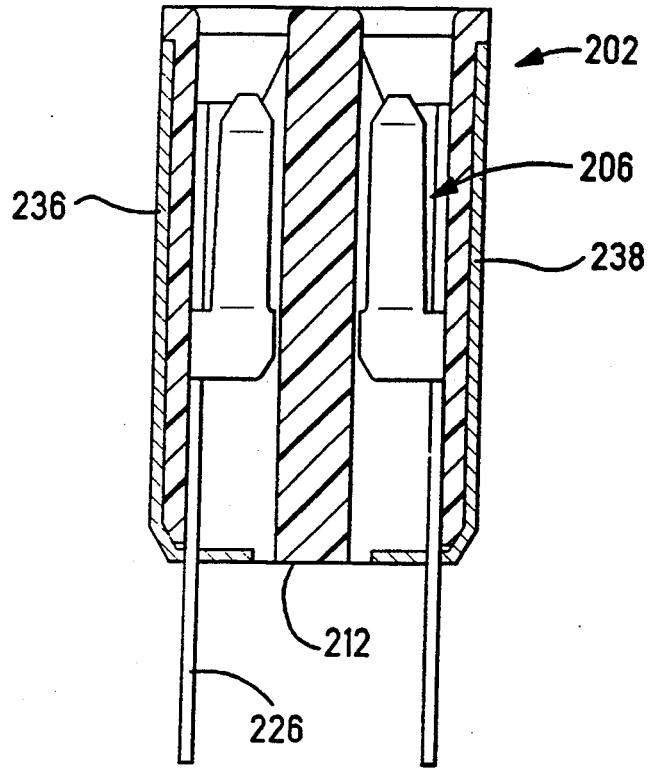
FIG. 6 is a cross sectional view through another embodiment of the invention.

Referring to FIG. 6, yet another embodiment 202 is shown whereby terminals 206 have straight terminal connection sections 226 and the filter elements 236,238 are folded under against the connector mounting face 212; the filter elements 236,238 having holes for providing a passage for the terminal connection sections 226. The mounting face is contiguous with the PCB when mounted thereon and soldering of the connection sections 226 also causes solder to flow to the filter elements thereby making electrical connection therebetween.

The invention as disclosed above is only descriptive of one of the embodiments and should not be limited to the claimed invention. More particularly, one could choose to have more ground electrodes connected to corresponding additional terminals that are connected to ground circuits, or a connector could have only one row of terminals with one filter element, or the number of signal electrodes N could be increased, corresponding to the number of terminals in the row of the connector, or one could even imagine that some of the terminals in the row do not require filtering and the filter element is partitioned only into the number of signal electrodes required for the filtered terminals. The shape of the connector could also be different, the filter elements being flexible and thus adaptable to non planar outer surfaces of a connector. Additionally, in order to increase the capacitance one could also imagine folding over the flexible filter element (foil) into two or more superposed layers. As the filter elements are flexible, other outer surfaces of the connector could also be used.

Advantageously therefore, the filtered connector of the present invention, comprises filter elements that can be readily and cheaply manufactured and adapted to the connector in an unobtrusive and compact manner.

We claim:

1. An electrical connector for carrying signals that could have unwanted frequency components, the connector having a housing and a number of electrical terminals greater than or equal to N, where N is an integer greater than zero, and at least one filter element for filtering the unwanted frequency components, characterized in that the filter element comprises a dielectric layer, a thin conductive layer of ground electrode on one side of the dielectric layer and on the other side thereof a thin conductive layer divided by insulating gaps into no more than N−1 distinct signal electrodes, whereby the filter element is electrically connected to N terminals of the connector, each signal electrode being connected to a separate said terminal and the layer of ground electrode being connected to the remaining one or more said terminals.

2. The electrical connector of claim 1 characterized in that said N terminals of the connector are identical.

3. The electrical connector of claim 1 characterized by two filter elements.

4. The electrical connector of claim 3 characterized in that the two filter elements are identical.

5. The electrical connector of claim 1 characterized in that there are N−1 distinct signal electrodes and one ground electrode.

6. The electrical connector of claim 1 characterized in that the layer of ground electrode covers almost all of the whole said one side of the dielectric layer.

7. The electrical connector of claim 6 characterized in that the whole layer of signal electrodes covers almost all of the whole said other side of the dielectric layer, except for the insulating gaps separating the signal electrodes.

8. The electrical contact of claim 1 characterized in that the signal electrodes occupy substantially equivalent surface areas.

9. The electrical connector of claim 1 characterized in that the connector housing has a complementary connector mating face and an opposing mounting face, a pair of longitudinal opposing side walls and an adjacent pair of opposing end walls extending therebetween, whereby the at least one filter element is mounted substantially against a side wall of the housing in a substantially flush manner.

10. The electrical connector of claim 9 characterized in that the filter element is of similar shape and surface area as the connector side wall.

11. The connector of claim 9 characterized in that the connector comprises a plurality of said terminals disposed in at least one row alongside one of the side walls, the terminals having tab portions extending beyond the mounting face and connected to connection tabs extending from the filter element for electrical connection between the terminals and the electrodes.

12. The connector of claim 11 characterized in that the connected filter element connection tabs and terminal tab portions are receivable in holes of a printed circuit board.

13. The connector of claim 11 characterized in that there are two rows of terminals, each alongside one of the sidewalls.

14. The electrical connector of claim 1 characterized in that the filter element comprises N connection tabs extending from a lower edge thereof, each of the connection tabs electrically connected to a distinct electrode via an integral conductive layer therewith, the connection tabs making the electrical connection between the electrodes and the connector terminals.

15. A filtered electrical connector, comprising:

a housing having a number of electrical terminals therein, said housing having a mounting face, said terminals having terminating portions extending from said mounting face, at least one of said terminals being a ground terminal, the other of said terminals being signal terminals; and a filter element for filtering unwanted frequencies, disposed along a wall of said housing, and having a dielectric layer, a thin conductive layer defining a ground electrode on one side of said dielectric layer, and on another side thereof a thin conductive layer divided by insulating gaps into signal electrodes, the filter element having the same number of signal electrodes as the number of signal terminals in said housing, said filter element having tab connection sections extending from said ground electrode and said signal electrodes and being electrically connected to said terminating portions of said terminals.

16. The electrical connector of claim 15, wherein there is one ground terminal and the remaining said terminals are signal terminals.

17. The electrical connector of claim 15, wherein the signal electrodes occupy substantially equivalent surface areas.

18. The electrical connector of claim 15, wherein the housing has a complementary connector mating face, a pair of longitudinal opposing side walls and an adjacent pair of opposing end walls extending between the mating face and the mounting face, whereby the at least on filter element is mounted substantially against a side wall of the housing in a substantially flush manner.

19. The connector of claim 18, wherein the connection tabs and terminating portions are receivable in holes of a printed circuit board.

20. The connector of claim 18, wherein the filter is of similar shape and surface area as the connector side wall.

* * * * *